US007393117B2

(12) United States Patent
Dalton et al.

(10) Patent No.: US 7,393,117 B2
(45) Date of Patent: Jul. 1, 2008

(54) FLASHLIGHT OR LIGHTING DEVICE

(75) Inventors: David R. Dalton, Turramurra (AU); Kang Woon Au, Kowloon (HK); Angelo Kotsis, Marrickville (AU); Michael Squires, Ryde (AU)

(73) Assignee: Eveready Battery Company, Inc., St. Louis, MO (US)

( * ) Notice: Subject to any disclaimer, the term of this patent is extended or adjusted under 35 U.S.C. 154(b) by 0 days.

(21) Appl. No.: 10/551,852

(22) PCT Filed: Mar. 29, 2004

(86) PCT No.: PCT/AU2004/000397

§ 371 (c)(1),
(2), (4) Date: Oct. 3, 2005

(87) PCT Pub. No.: WO2004/088204

PCT Pub. Date: Oct. 14, 2004

(65) Prior Publication Data

US 2006/0274520 A1 Dec. 7, 2006

(30) Foreign Application Priority Data

Apr. 3, 2003 (AU) ..... 2003901553

(51) Int. Cl.
*F21L 4/00* (2006.01)

(52) U.S. Cl. ..... 362/157; 362/158; 362/183; 362/205; 362/208

(58) Field of Classification Search ..... 362/157, 362/158, 205, 204, 183, 178, 206, 208
See application file for complete search history.

(56) References Cited

U.S. PATENT DOCUMENTS

| | | | | |
|---|---|---|---|---|
| 3,888,127 | A * | 6/1975 | Shamlian et al. | 73/431 |
| 4,092,580 | A * | 5/1978 | Prinsze | 320/115 |
| 4,348,715 | A * | 9/1982 | Christensen et al. | 362/109 |
| 5,772,309 | A * | 6/1998 | Groben | 362/183 |
| 6,244,723 | B1 * | 6/2001 | Talamo | 362/208 |
| 6,355,885 | B1 * | 3/2002 | Rintz et al. | 174/66 |
| 6,505,952 | B1 * | 1/2003 | Kish et al. | 362/197 |
| 2003/0039118 | A1 * | 2/2003 | Osiecki et al. | 362/208 |
| 2003/0137834 | A1 * | 7/2003 | Jigamian et al. | 362/205 |
| 2003/0184997 | A1 * | 10/2003 | Mah | 362/157 |
| 2003/0223227 | A1 * | 12/2003 | Levine | 362/183 |
| 2005/0281020 | A1 * | 12/2005 | Liaw et al. | 362/157 |

FOREIGN PATENT DOCUMENTS

| | | | |
|---|---|---|---|
| WO | 1993/12374 | A1 | 6/1993 |
| WO | 2000/29780 | A1 | 5/2000 |
| WO | 2001/61244 | A1 | 8/2001 |

* cited by examiner

*Primary Examiner*—Ali Alavi
*Assistant Examiner*—Evan Dzierzynski
(74) *Attorney, Agent, or Firm*—Gregory J. Adams

(57) ABSTRACT

A flashlight (10) including: a housing (12) with a light source (104), a power source (142), and an aperture (126) through the housing (12) that is closed by a resilient cover (112). The resilient cover (112) extends over a switch assembly (18) and provides a waterproof seal for the housing (12). An indicator means (146), when illuminated, is visible through the resilient cover (112). A waterproof flashlight (10) having an electric contact (154) extending through a contact aperture (38) formed in the housing (12) with resilient sealing means (164) between to establish a water tight seal. A securement means (158) to place the resilient means (164) under compression. When not in use, the flashlight (10) may be stowed on a base (40) for recharging through the electrical contact (154).

32 Claims, 13 Drawing Sheets

FLASHLIGHT OR LIGHTING DEVICE

FIELD OF THE INVENTION

This invention relates to a flashlight or lighting device assembly.

BACKGROUND OF THE INVENTION

Flashlights and waterproof flashlights are well known. The flashlight market is considered by some to be a relatively mature but highly competitive. There is a need to provide features which help make a flashlight attractive to a consumer, thereby providing value and differentiation in the market place.

The applicant does not concede that the prior art discussed in the specification forms part of the common general knowledge in the art at the priority date of this application.

SUMMARY OF THE INVENTION

The present invention provides a flashlight including: a housing having at least one aperture therethrough; a light source within the housing; a power source within the housing; electrical switch means associated with the housing for forming an electrical circuit between the light source and the power source, said electrical switch means cooperating with said aperture to allow a user to actuate said switch means between a circuit open and circuit closed condition; a resilient cover extending over the electrical switch means and providing a waterproof seal for the housing preventing ingress of water through said aperture; and at least one indicator means being visible through said cover at least when said indicator means is illuminated.

The at least one indicator means can include a light source which is used to assist a user to locate said light. The at least one indicator means can include a light source for indicating a status of the power. The at least one indicator means includes a light source for indicating the recharging status of the power source. The at least one indicator means includes a light source for indicating the discharging status of the power source.

The aperture can be provided in a recess in said housing.

The cover can cooperate with a rim of said recess to provide a waterproof seal.

The electrical switch means can be a switch within the housing.

The switch can be actuated by a switch actuator which passes through said aperture, to enable a user to push said actuator to actuate said switch.

The at least one indicator means can include at least one LED.

The at least one indicator means can pass through said housing.

There can be at least a pair of indicator means, or three indicator means.

The or each indicator means can be disposed under the resilient cover. At least part of the resilient cover can be translucent or transparent. The cover can be of an elastomeric or polymeric material. The cover can include silicone.

The power source can be a rechargeable battery. The flashlight can include connection means for connecting said rechargeable battery to an external power supply to recharge the battery. The flashlight can include a recharging circuit, to which said indicator means is electrically connected.

The indicator means can be visible through said cover, when said indicator means is or is not indicating a status of said power source.

The present invention also provides a method of providing an indicator means for a lighting device, said indicator means being adapted to provide a signal to a user of said lighting device, said device including a cover over a switch member of a switch means which will open and close a circuit between said power source and a lamp means, said method including the steps of: providing said cover from a selection of a translucent, transparent or other see-through means; locating said indicator means below said cover.

The indicator means can be visible through said cover when said indicator means is providing said signal.

The indicator means need not be visible through said cover when said indicator means is not providing said signal.

The lighting device can be a flashlight. The flashlight can be a waterproof flashlight.

The cover can prevent ingress of water.

The at least one indicator provides an indication of one or more than one of the following: charging status; discharging status; location of the lighting device. The location of the lighting device can be produced by a bright coloured light source which is lighted intermittently or is otherwise flashing.

The present invention also provides a flashlight and stand assembly including: a flashlight having a flashlight guide formation; and said stand including a base having a base guide formation, the flashlight and base being configured for mutual engagement with the flashlight at a first flashlight position such that the flashlight is slidable in a first direction relative to the base to a second flashlight position, and wherein the guide formations are configured to permit movement of the flashlight relative to the base and to said first direction when the flashlight is in said first position, to guide the flashlight relative to the base during movement in the first direction from the first position to the second position, and to substantially prevent lateral movement of the flashlight relative to the base and to the first direction when the flashlight is in the second position, while permitting movement of the flashlight in a second direction opposite the first direction.

One of the flashlight guide formation and base guide formation can be a male formation and the other of the flashlight formation and base formation can be a complementary female formation. The male formation can be an elongate rib tapering from a broad rib end to a narrow rib end, and the female formation is an elongate slot tapering from a broad slot end to a narrow slot end, the slot being open at the broad end.

The rib can have an upper rib surface and lower rib surface, the rib surfaces curving towards each other from the broad rib end to the narrow rib end.

The slot can have an upper slot surface and lower slot surface, the slot surfaces curving towards each other from the broad slot end to the narrow slot end.

The base can include a pair of spaced side walls configured for accommodating the flashlight therebetween, the flashlight being slidable between the side walls from the first position to the second position.

The base can include two said male formations, each being disposed on a respective side wall and wherein the flashlight includes a flashlight housing having two opposite sides, each said side defining a respective said female formation.

The base can include a rear wall interconnecting the side walls, the flashlight being slidable generally parallel to the rear wall from the first position to the second position.

The base can also include a bottom wall which serves as a stop to prevent the flashlight from moving further than said first position in said first direction.

The base can include at least one base electrical contact and the flashlight includes at least one respective flashlight electrical contact, the at least one base electrical contact and at least one flashlight electrical contact being in electrical connection with each other when the flashlight is in the second position.

The at least one base electrical contact can be located by the rear wall and the at least one flashlight electrical contact can be located in the flashlight housing, and is disposed so as to move into alignment with the base electrical contact as the flashlight moves into the second position in the first direction.

The base can have a pair of said base electrical contacts, and the rear wall can define a pair of apertures, each base electrical contact projecting through a respective aperture, and wherein the flashlight has a pair of said flashlight electrical contacts, each disposed so as to move into alignment with a respective base electrical contact as the flashlight moves into the second position in the first direction.

The at least one base electrical contact can be biased, and wherein the flashlight and stand assembly is configured to apply pressure against said bias to the at least one base electrical contact when the flashlight is in the second position.

The base can include power connection means for connection to a power source.

The power connection means can include a connection housing having a wall with a connection hole opening therethrough, the connection housing being configured to support an electrical socket connector adjacent or within the hole.

The present invention also provides a waterproof flashlight including: a flashlight housing defining a contact aperture opening therethrough; a flashlight electrical contact for electrical connection of the flashlight to a power source, the flashlight electrical contact being disposed at least partly outside the flashlight housing and defining a shoulder adjacent the housing; resilient sealing means sandwiched between the shoulder and the flashlight housing to establish a water tight seal between the shoulder and the housing; and contact connection means for connecting the flashlight electrical contact to the flashlight housing, the contact connection means extending from the flashlight electrical contact through the contact aperture and including securement means securing the contact connection means in relation to the flashlight housing such that the shoulder maintains the sealing means under compression.

The resilient sealing means can be an elastomeric or polymeric washer.

The contact connection means can include a shaft portion extending from the flashlight electrical contact.

The securement means can be disposed within the flashlight housing and is constituted by a deformable portion of the contact connection means, configured to be deformed so as to lock the contact connection means and hence the flashlight electrical contact, in place relative to the flashlight.

A washer can be disposed between the deformable portion and an inner wall of the flashlight housing.

The flashlight electrical contact and the contact connection means can be a unitary component. The unitary component can be in the form of a rivet.

Preferably the shoulder is defined by a flange.

The flashlight housing can define a recess having a recess floor, the flashlight electrical contact being disposed within the recess and projecting from the contact aperture and outwardly from the recess floor.

BRIEF DESCRIPTION OF THE DRAWINGS

Embodiments of the present invention will now be described, by way of example only, with reference to the accompanying drawings, in which.

DETAILED DESCRIPTION OF THE EMBODIMENTS

Figure 1:
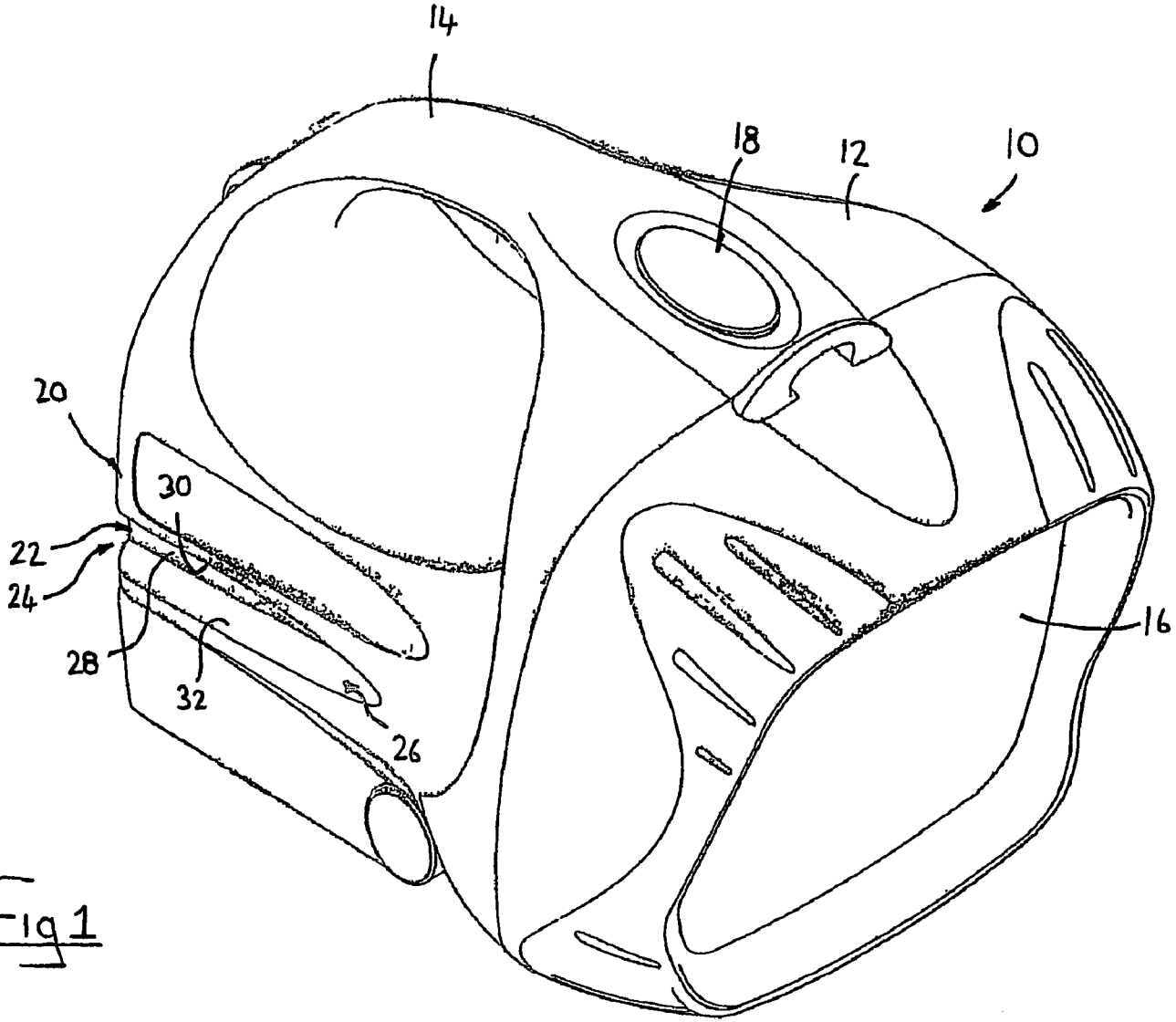
FIG. 1 is a perspective view, from above, of a flashlight in accordance with an embodiment of the invention.

The description below of the embodiments of the invention is with reference to a rechargeable waterproof flashlight. It will be readily understood that other lighting devices, whether rechargeable or not, or waterproof or not, can also embody the invention.

Referring to FIGS. 1 to 4 and 9, there is shown a flashlight 10 having a housing 12, a handle 14, a lens 16 and a switch assembly 18. The housing 12 has two opposite sides 20 each having defined therein a slot 22.

The slot 22 is elongate, having a broad end 24 and a narrow, sharp end 26. The slot 22 has a floor 28, and upper surface 30 and a lower surface 32. The upper and lower surfaces 30 and 32 curve towards each other from the broad end 24 to the sharp end 26 so that each slot 22 tapers from the broad end 24 to the sharp end 26. It will be noted that the broad end 24 of each slot 22 is an open end.

Figure 2:
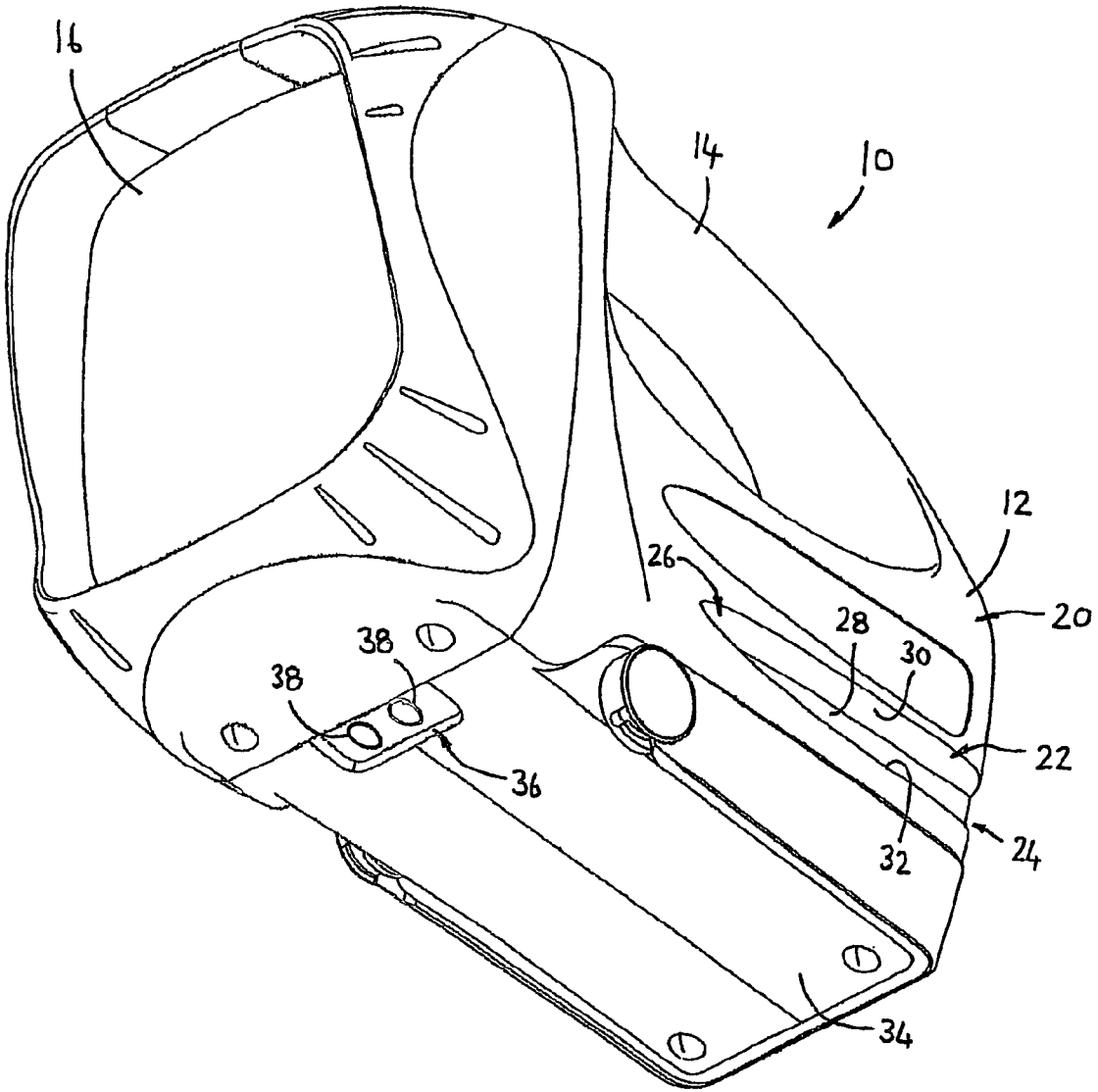
FIG. 2 is a perspective view, from underneath, of the flashlight of FIG. 1.
Figure 3:
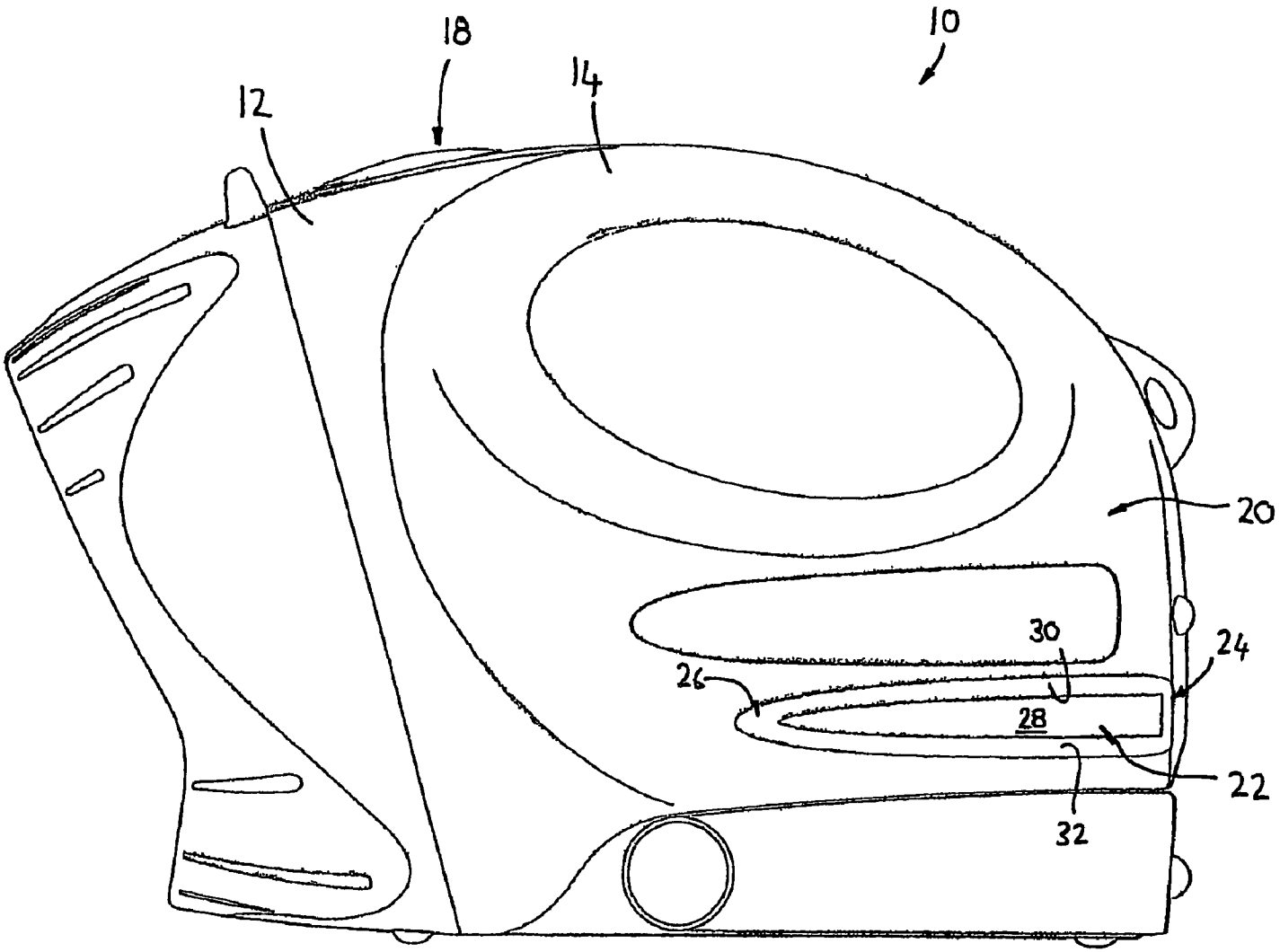
FIG. 3 is a side elevation of the flashlight of FIG. 1.
Figure 4:
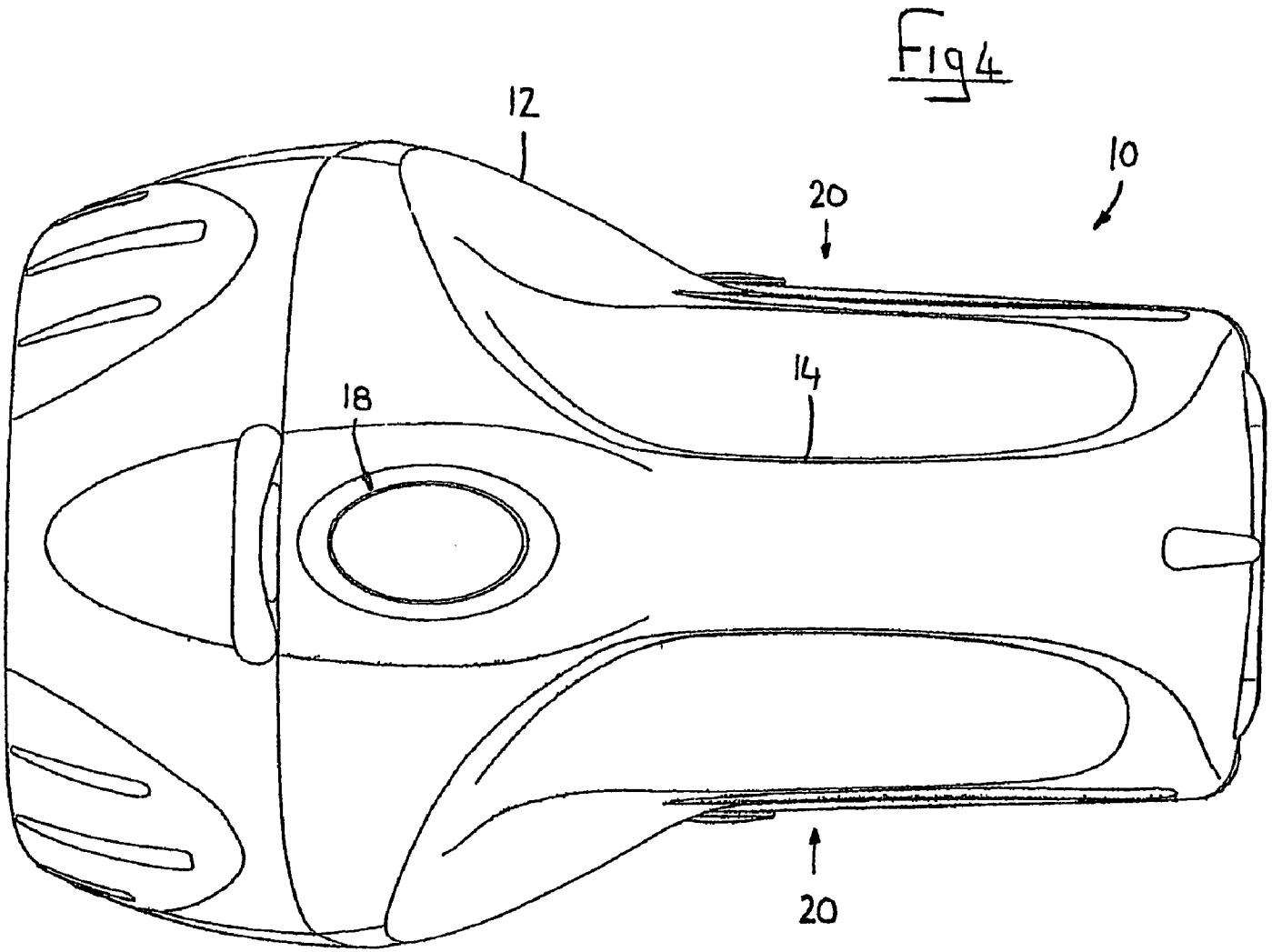
FIG. 4 is plan view of the flashlight of FIG. 1.

Referring to FIG. 2, the housing 12 of the flashlight 10 has a base wall 34 in which a recess 36 is defined. A pair of apertures 38 are formed to open through the base wall 34, within the recess 36.

Referring now to FIGS. 5 to 8, there is shown a base 40, which is for accommodating the flashlight 10, in a manner that is described below. The base 40 has a pair of side walls 42, a rear wall 44 interconnecting the side walls 42 and a bottom wall 46.

The rear wall 44 defines four recesses 47 which form mountings 48 with screw holes 50 extending through these.

The rear wall 44 also has a pair of adjacent contact apertures 52 and a pair of shaped electrical contacts 54 which project through the contact apertures 52. The electrical contacts 54 are of metal and riveted or secured at 93 to the rear face of the rear wall 44, thereby being connected in a cantilevered fashion to the base 40. The length of the arm 57 from the rivet 93 to the aperture 52 provides a spring or bias when the portion of the contact 54 which protrudes through the aperture 52 is pushed toward the rear wall 44.

Figure 5:
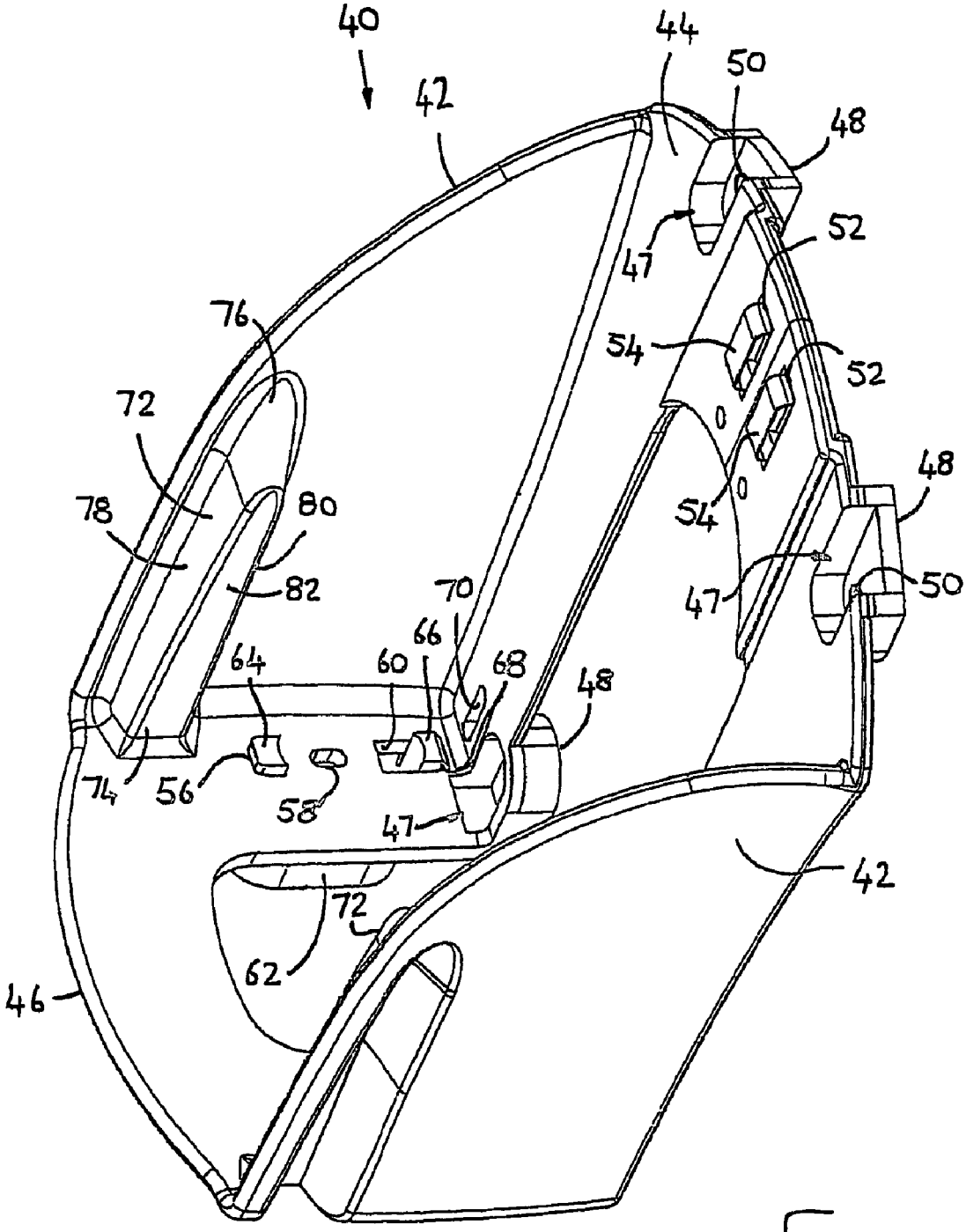
FIG. 5 is perspective view, from above, of a base for supporting the flashlight of FIG. 1.
Figure 6:
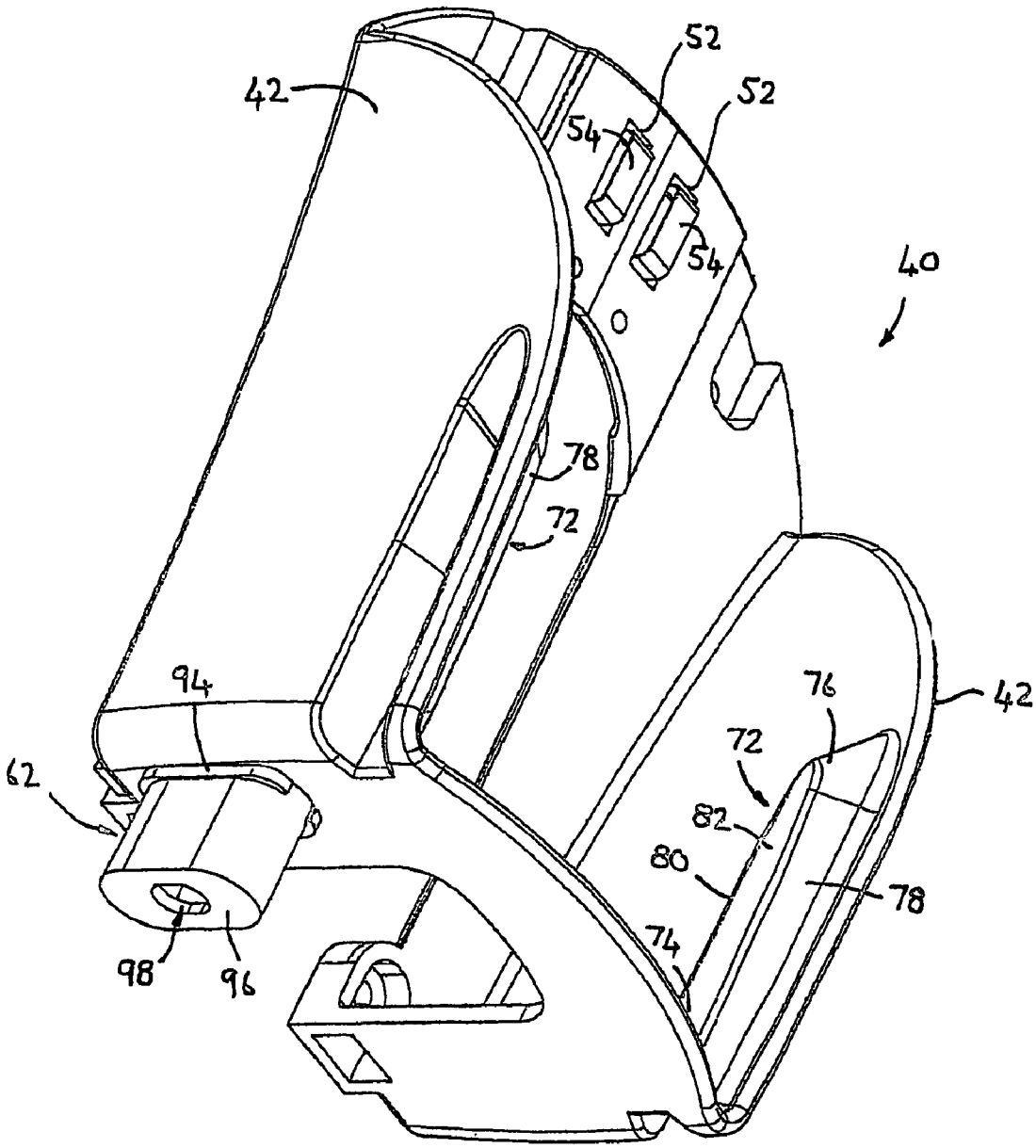
FIG. 6 is a perspective view, from below, of the base of FIG. 5.
Figure 7:
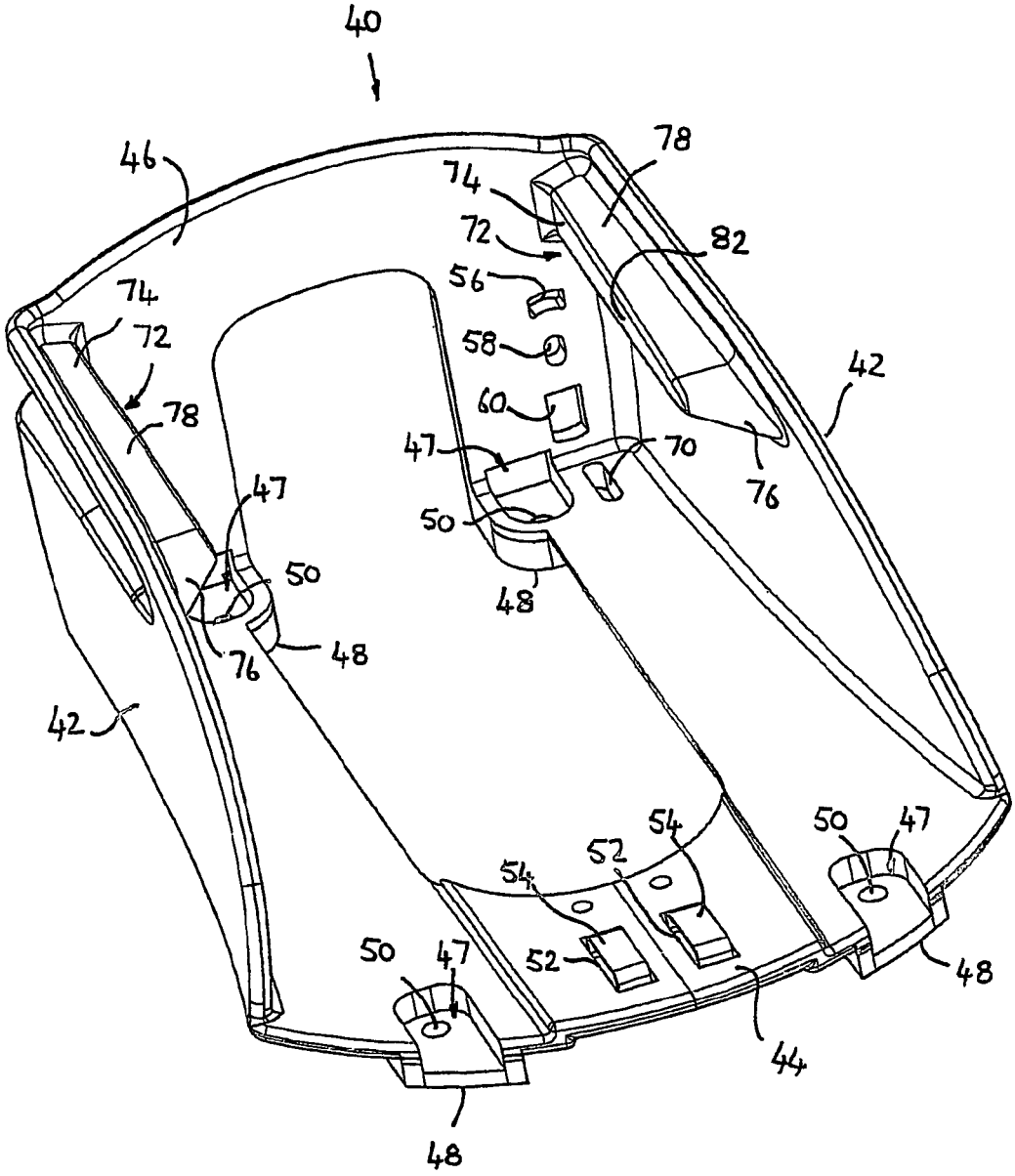
FIG. 7 is a perspective view, from above, of the base, showing more detail of the interior of the base with the power connector housing removed.
Figure 8:
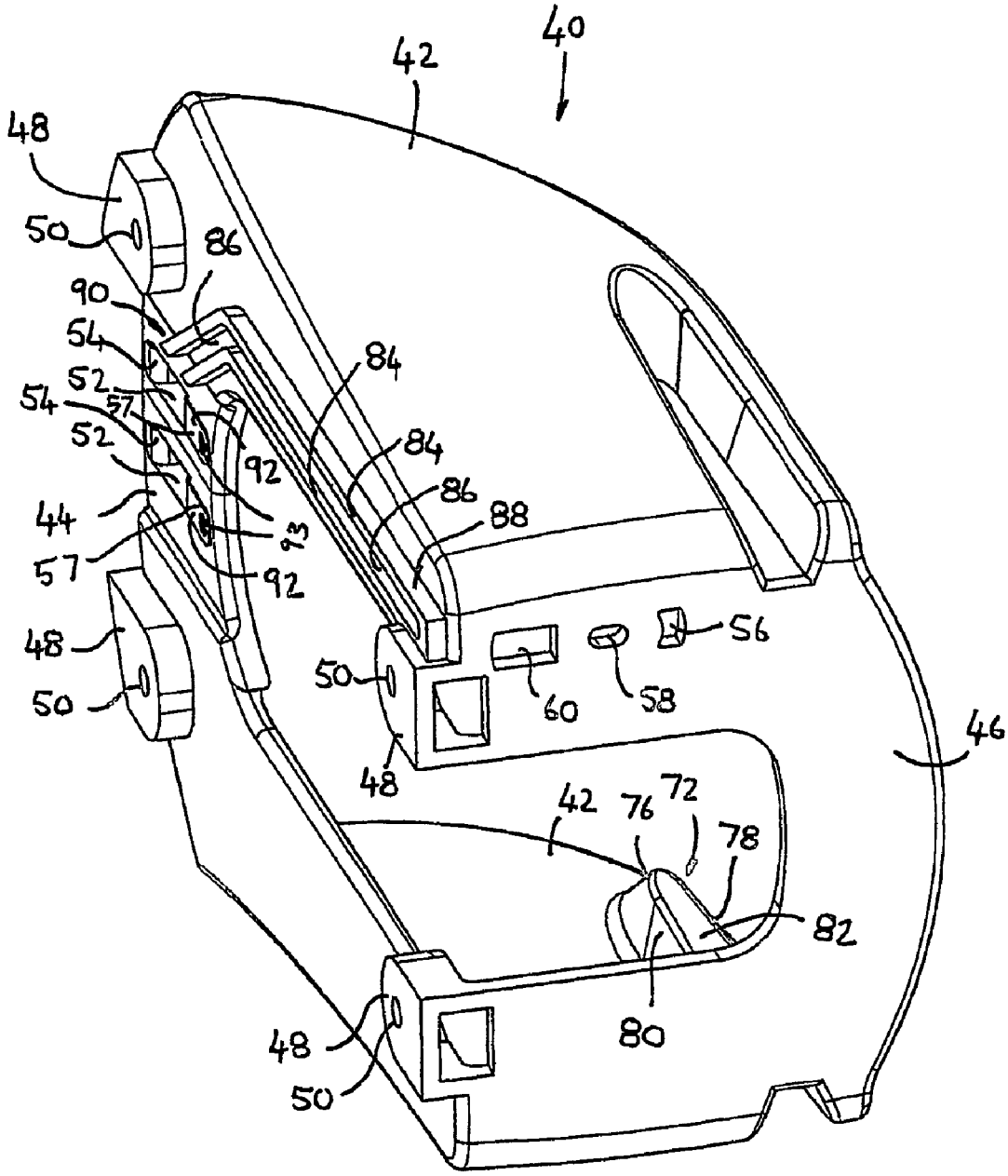
FIG. 8 is a further perspective view, from below, of the base with the power connector housing removed.

As also best shown in FIGS. 5, 7 and 8, the bottom wall 46 has a series of holes 56, 58 and 60 therein, the hole 60 being of generally rectangular form. A power connector housing 62 (as best seen in FIGS. 6 and 12 to 14) having two lugs 64 and 66 is mounted on a bottom side of the bottom wall 46, with the lug 64 extending through the hole 56, and the lug 66 extending through the hole 60. The lug 66 includes a snap formation 68, so that the power connector housing 62 can be engaged with the bottom wall 46 by forcing the power connector housing 62 against the bottom wall 46 so that the lug 64 passes through the hole 56 and the lug 66 passes through the holes 60 until the snap formation 68 snap engages with a rear inner edge of the hole 60.

The rear wall 44 also includes a cable hole 70.

There is provided on the inner side of each side wall 42 a male formation in the form of an elongated rib 72. Each rib 72 extends from a broad end 74 to a narrow, sharp end 76. The broad end 74 of each rib 72 is formed integrally with an inner surface of the bottom wall 46.

Each rib 72 has an front surface 78, a rear surface 80 and an inwardly projecting face 82. The front and rear surfaces 78 and 80 curve towards each other from the broad end 74 to the sharp end 76, so that each rib 72 tapers from the broad end 74 to the sharp end 76.

The ribs 72 are shaped so as to be complementary to the slots 22 of the flashlight 10, as described in more detail below.

Referring to FIG. 8, the rear wall 44 of the base 40 has a pair of parallel spaced walls 84 which define a channel 86 between them. The cable hole 70 (not visible in FIG. 8) opens into the channel 86. One end of 88 of the channel 86, which is adjacent the cable hole 70, is closed while the opposite end 90 of the channel 86 is open. The open end 90 is adjacent the contact apertures 52 in the rear wall 44, and hence also adjacent the electrical contacts 54 which project through the contact apertures 52.

The channel 86 is to accommodate wiring (not shown) to connect the electrical contacts 52 to an external power supply (not shown). The electrical wiring, when provided, is connected at one end in the vicinity of portion 92 of the electrical contact 54. If desired the securement at 93 could also be used, say if for example a screwed securement is used. The wiring then extends along the channel 86, through the cable hole 70 immediately above the bottom wall 46, and through the hole 58 into the power connector housing 62.

As best seen in FIG. 6 and FIGS. 12 to 14, power connector housing 62 has a rim 94 which abuts the lower surface of the bottom wall 46 when the power connector housing 62 is engaged with the base 40. The power connector housing 62 has an end wall 96 with a connection aperture 98 opening through this wall. Within the power connector housing 62 there is provided a pair of bosses 100, which are integrally formed on an internal surface of the end wall 96. Each boss 100 has a passage 102 therein. The passages 102 are for accommodating screws (not shown) for securing a bracket (not shown), which in turn holds a pin socket (not shown) such that it projects through the connection aperture 98. The pin socket is for connection to the wires that are connected to the rear parts 92 of the electrical contacts 54.

Figure 9:
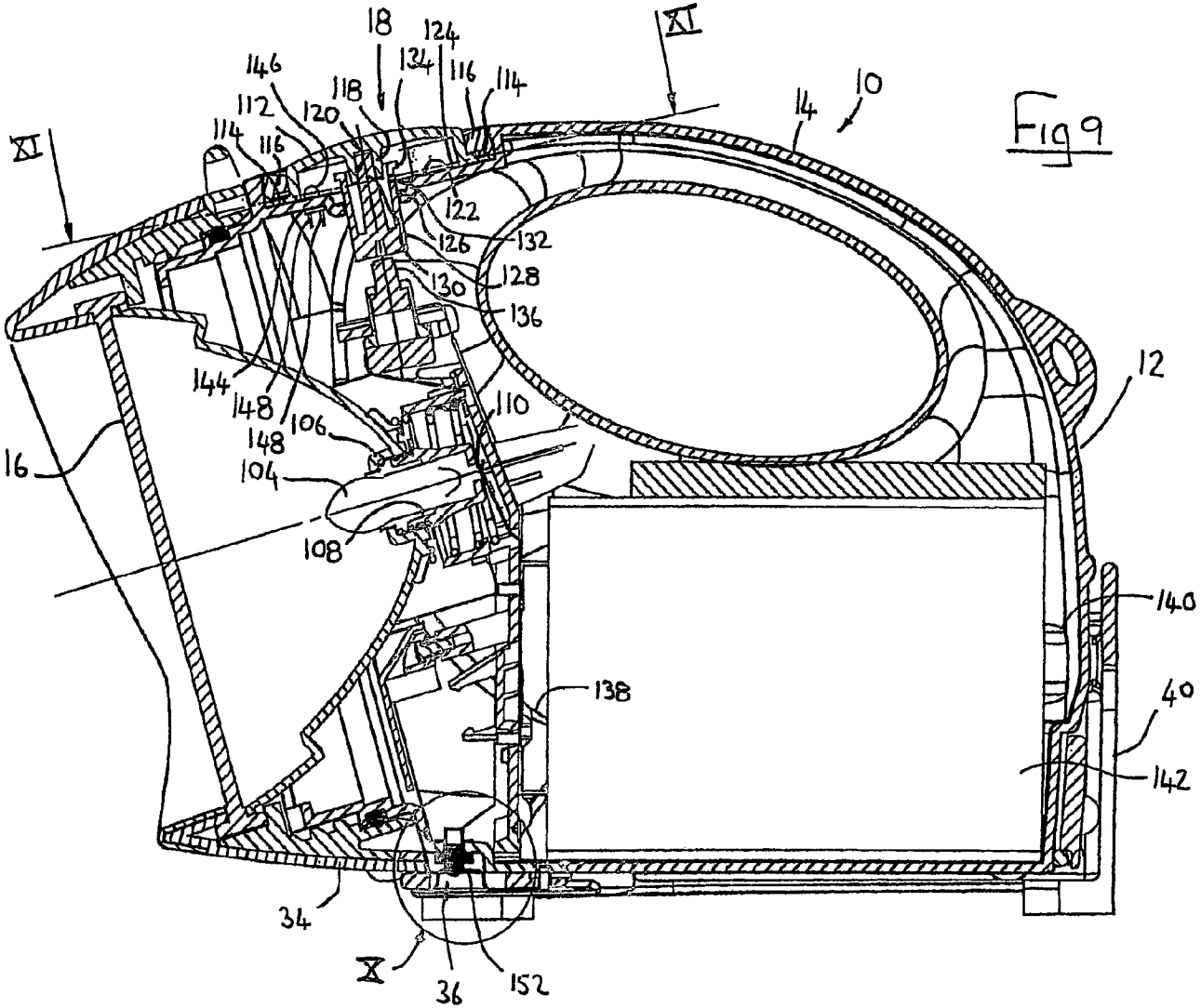
FIG. 9 is a cross sectional view through the centre flashlight of FIG. 1 mounted on the base of FIG. 5 which is also cross sectioned through its centre.

Referring now to FIG. 9, as can be seen, the flashlight 10 includes a light source 104 which is held in a light source support 106 by a screwed connection, so as to be in contact with light source contacts 108 and 110, the contact 108 being disposed within the support 106.

Figure 11:
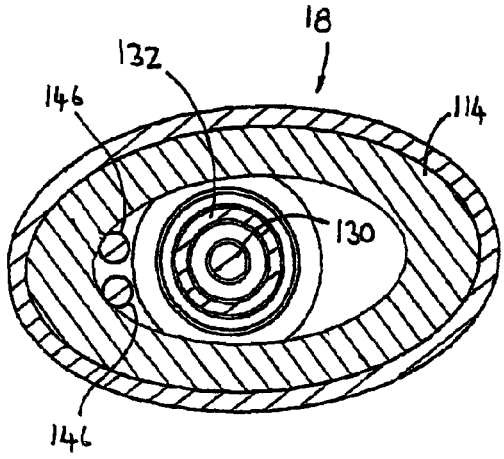
FIG. 11 is a section view along lines XI-XI in FIG. 9.

The switch assembly 18 includes a cover 112 (as also seen in FIG. 11) of translucent elastomeric material. The cover 112 can include silicone. The cover 112 has a cover surround 114 which is secured to the housing 12 by a retainer 116. The cover 112 includes, at its underside, a socket formation 118 defining a socket 120.

The cover 112 is held by the retainer 116 within a recess 122 in the upper side of the housing 12. The recess 122 has a floor 124 which defines an aperture 126. An actuator 128 extends through the aperture 126, and has a protrusion 130 projecting into the socket 120. Surrounding the protrusion 130 is an inverted skirt 132 having a flange 134 forming a rim of the inverted skirt 132. The actuator 128 is prevented from passing through the aperture 126 by the flange 134.

Disposed below the actuator 128 is a switch 136. The switch 136 is electrically connected (in a manner not shown) to a circuit which includes the contacts 108 and 110 and which also includes further contacts 138 and 140. The contacts 138 and 140 are for connection to a rechargeable battery 142, also disposed in the housing 12.

The switch 136 is configured such that pressing it once closes the circuit so that the battery 142 can provide power to illuminate the light source 104, and such that pressing it a second time opens the circuit thus turning off the light source 104. The switch 136 is positioned so as to be depressed, and thus actuated, by the actuator 128. The actuator 128, in turn, is moved by pressing down on the cover 112.

The floor 124 of the recess 122 also has a further pair of apertures 144 each having an indicator means in the form of an LED 146 such as for example one red LED and one green LED, extending therethrough. Each LED 146 has a pair of LED contacts 148 which are connected by wires (not shown) to a charging circuit having appropriate electronic components as is known by those skilled in the art (also not shown), which in turn is electrically connected to the battery 142. As described in more detail below, the LEDs 146 are for indicating the recharging status of the battery 142.

Figure 10A:
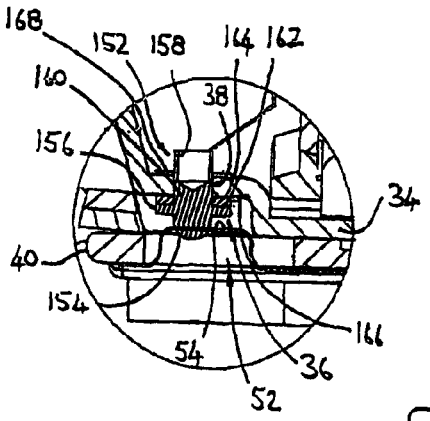
FIGS. 10A and 10B respectively illustrate an enlarged view of the detail X in FIG. 9 and an enlarged view of a subset of the detail X in FIG. 9.
Figure 10B:
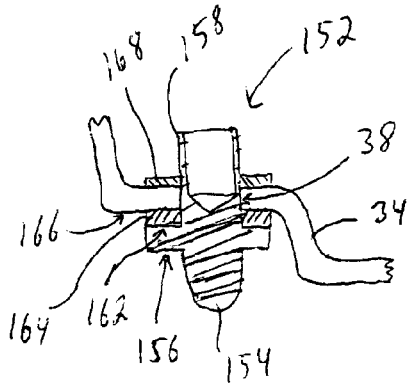
Figure 12:
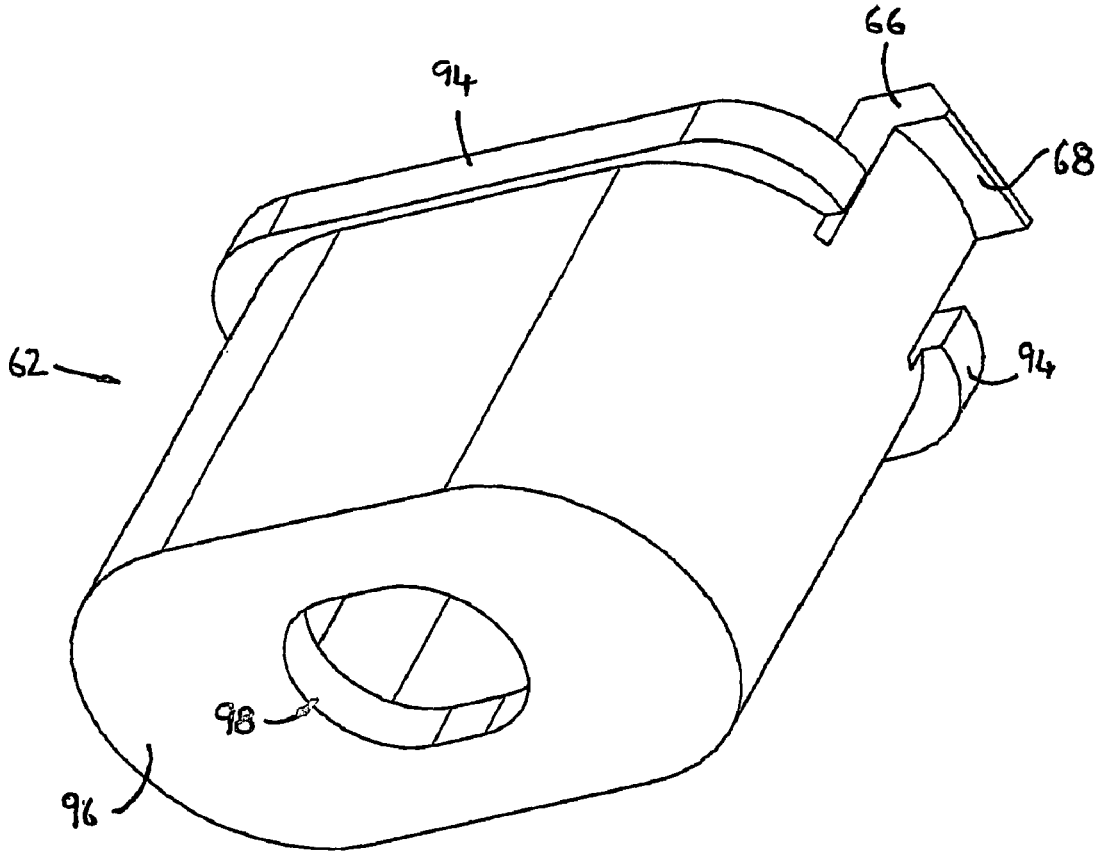
FIG. 12 is a perspective view from below, of a power connector housing forming part of the base of FIG. 5.
Figure 13:
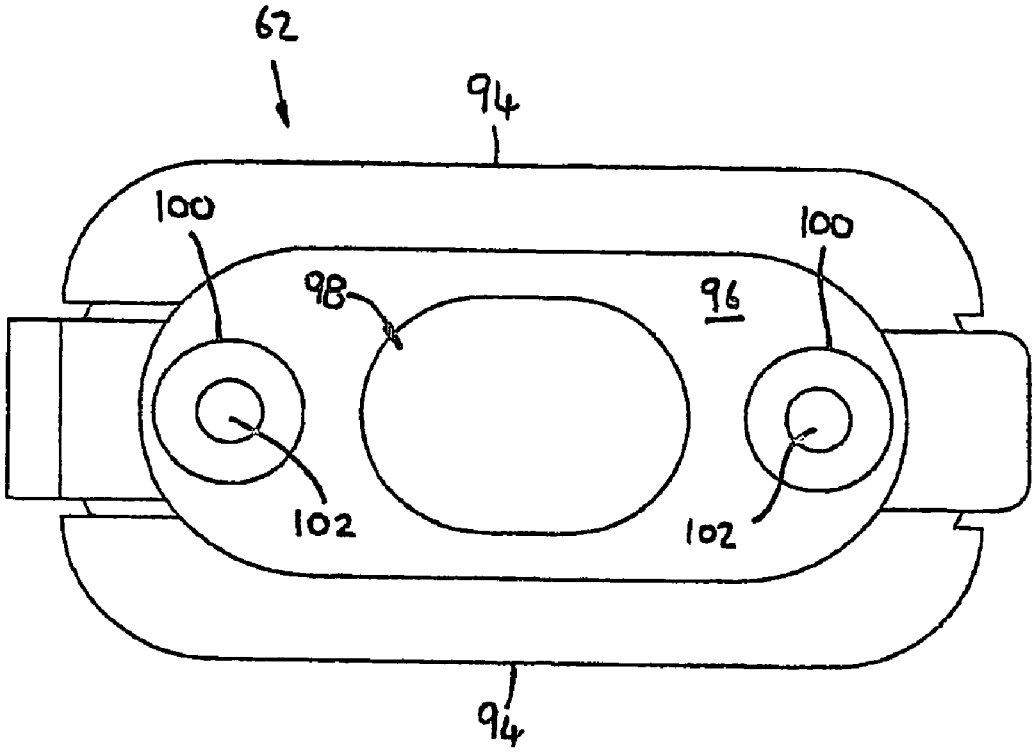
FIG. 13 is a plan view of the power connector housing of FIG. 12.
Figure 14:
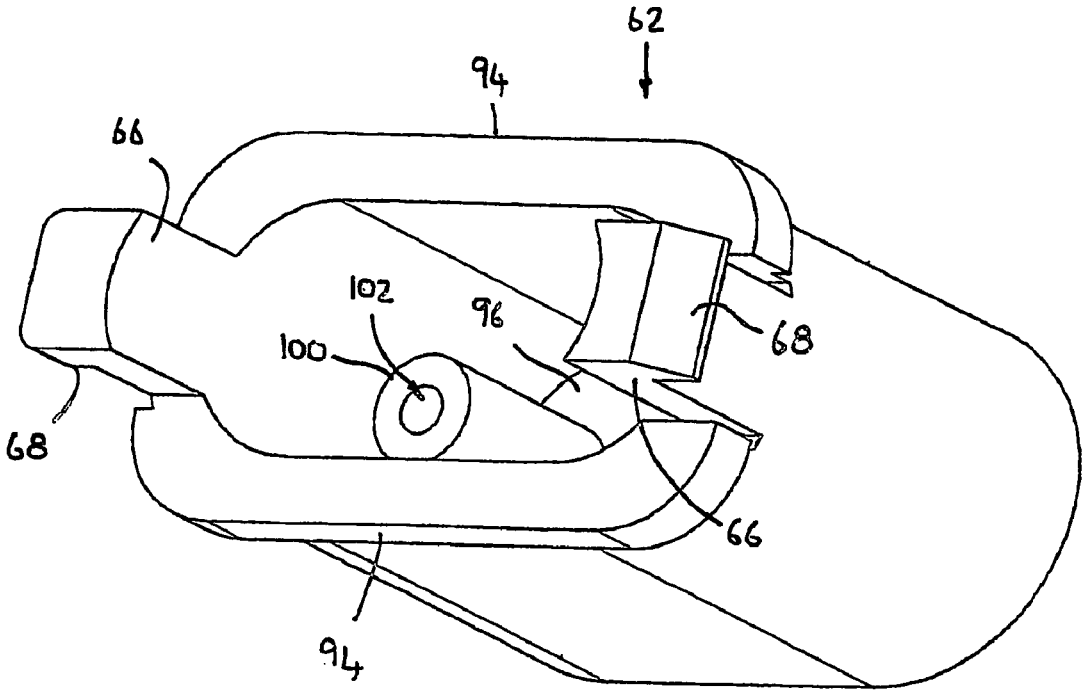
FIG. 14 is a perspective view, from above, of the power connector housing of FIG. 12.

Referring now to FIGS. 10A and 10B, there is provided a pair of electrical contact structures 152 located in the apertures 38 which disposed in the recess 36 in the base wall 34 of the flashlight 10 and which extend or project outwardly from the recess 36. In FIGS. 10A and 10B, only one contact structure 152 is able to be seen. Each contact structure 152 includes an electrical contact 154 which includes a flange 156. The contact structure 152 also including a rivet end 158 and a shaft portion 160 interconnecting the electrical contact 154 and the rivet end 158. The flange 156 defines a shoulder 162, with an elastomeric washer 164 being disposed between the shoulder 162 and an underside 166 of the housing 12 in the recess 36. Also provided is a washer 168 disposed to encircle the rivet end 158.

The rivet end 158 is shown in FIGS. 10A and 10B as being in an undeformed state, prior to completion of the assembly and securement of the contact structure 152 in the respective aperture 38. However, to complete this securement, the rivet end 158 is deformed outwardly, which involves cold working thereof, in a manner usually employed in relation to rivets as will be understood by those skilled in the art, so that the rivet end 158 is "rolled" downwards so as to press against the upper side of the washer 168. Once in this condition, the rivet end 158 effectively places the contact structure 152 under compression, urging the shoulder 162 upwardly (in the orientation shown in FIGS. 10A and 10B, to compress the elastomeric washer 164. This effects a substantially water-proof seal around the aperture 38 through which each respective contact structure 152 extends It will be noted in FIG. 10A that the electrical contact 154 appears to overlap the location of the relevant electrical contact 54 which is secured in the contact aperture 52 of the base 40. As described above, each of the electrical contacts 54 is biased by its cantilevered mounting so that when the flashlight 10 is engaged with the base 40 as described below, the electrical contacts 154 in the flashlight 10 engage the electrical contacts 54 in the base 40, bending or resiliently deforming the arms 57 of the electrical contacts 54, providing bias so as to ensure an effective electrical connection between the two.

When the flashlight 10 is not in use, it can be stowed on the base 40, where it can be recharged.

The base 40 can be mounted on a vertical surface such as a wall (not shown) using screws (not shown) which pass through the screw holes 50 in the mountings 48. The base 40 is mounted in this way, with the bottom wall 46 facing downwards. It will be noted that the mountings 48 stand proud of the rear face of the rear wall 44, which provides space behind the rear wall 44 to accommodate the wires in the channel 86. When the base 40 is mounted, the pin socket (not shown) which is located in the power connector housing 62 as described above is connected to a complementary pin connector. The pin connector, in turn, is connected to a power supply (not shown) and this can include a transformer. This power supply, via the pin connector, pin socket, and wiring in the channel 86, supplies electrical power to the electrical contacts 54.

After the flashlight 10 has been used, it can be placed on the base 40 by positioning the rear end of the flashlight 10 (the end opposite the lens 16) in a first position relative to the base 40, that is, with the broad ends 24 of the slots 22 being positioned immediately adjacent the sharp ends 76 of the ribs 72 of the base 40. It will be appreciated that, in this position, as the broad ends 24 of the slots 22 are wider than the sharp ends 76 of the ribs 72, a certain amount of lateral play of the flashlight, towards and away from the rear wall 44 of the base 40, is permitted.

The flashlight 10 can then be slid, downwards relative to the base 40, towards the bottom wall 46. As the flashlight 10 is slid in this way, the ribs 72 slide further into the slots 22 until, when the flashlight 10 reaches the extent of its travel in the downward direction, the ribs 72 are fully received within the slots 22. As the ribs 72 and slots 22 are complementary to each other, in this, second position of the flashlight 10, the interaction of the ribs 72 and slots 22 prevent any lateral movement of the flashlight 10 relative to the base 40 in a direction towards or away from the rear wall 44, with the side walls 42 preventing lateral movement of the flashlight 10 relative to the base 40 in a direction towards or away from either of these side walls 42. Of course, the flashlight 10, when in this position, is free to be slid in an upward direction, to remove it from the base 40.

The ribs 72 and slots 22 also serve to guide the flashlight 10 relative to the base 40 as the flashlight 10 is slid from its first position to its second position. The bottom wall 46, together with the interaction of the ribs 72 and slots 22, prevent the flashlight 10 from moving further downwards than the second position.

When the flashlight 10 is in its second position as described, the electrical contacts 154 in the recess 36 of the housing 12 are in electrical contact with the electrical contacts 54 of the base 40 so that power can be supplied, from the above mentioned power supply, to the rechargeable battery 142 of the flashlight 10, to recharge the battery 142.

In use, the flashlight 10, having been removed from the base 40, can be turned on by a user pressing on the cover 112. This causes the actuator 128 to be moved inwards relative to the flashlight 10 and this, in turn, presses on the switch 136 to close the electrical circuit within the flashlight 10, to illuminate the light source 104. To turn off the flashlight, the cover 112 can be pressed again to open the circuit and turn out the light source 104. The cover 112 thus allows the flashlight 10 to be activated and deactivated without the waterproof integrity of the flashlight 10 being compromised.

The cover 112 also serves to provide waterproofing means over the LEDs 146, and this means of mounting LEDs 146 means that the waterproofing of the housing 12 is not compromised, and additional sealing is not required.

The flashlight 10 can be configured such that the LEDs 146 indicate the recharging status of the battery 142 while the flashlight 10 is located on the base 40 as described above. Thus for example, one of the LEDs 146 can be configured to indicate that the battery 142 is charging, by for example being red and blinking, while the other LED 146 can indicate when the battery 142 is fully charged to inform a user that the flashlight 10 can be readily used, by for example being green and unblinking.

The LEDs 146 can, in different embodiments, be of different colours. For example, one of the LEDs 146 which is for indicating that the battery 142 is charging may be orange while the other LED 146 which indicates when the battery 142 is fully charged, may be blue. The choice or selection of the colours of LEDs 146 is somewhat dependent upon the nature of the cover 112. For example its colour, it being transparent or translucent, and thus the interaction of the colour of the light emitted from the LED and the effect or appearance of that light when viewed through the cover 112.

The LEDs 146 when lighted can be seen through the cover 112, which is at least translucent but could also, if preferred be transparent.

If desired, on the waterproof flashlight described above, a third LED can be provided. Such a third LED can be a bright coloured LED such as a white or orange LED. This third LED can be configured in the circuit with the battery and a blinking circuit, so that the LED is caused to blink or be lighted intermittently, providing the battery is charged and the flashlight is off. That way in a darkened cupboard or room, the flashlight is readily identifiable.

Such a location identifier feature can also be used when the flashlight is on and operational, as sometimes flashlights fall on the ground face down, or their light is obscured, and as such, the location identifier could still be visible giving greater chance that the light can be found. Further, due to the robust nature of the LED construction, there is a chance that if a flashlight is dropped, the lamp or globe may expire, but the LED may not.

The location identifier is particularly useful, in both non waterproof and water proof environments. If a waterproof floating light with this feature is dropped overboard and is not switched on, it may be readily located by the location identifying feature.

In a non waterproof, non rechargeable version of the light, there would only be a need to provide the location identifying feature and thus only one LED need be provided.

The nature of the cover 112 and the nature of the contact structures 152 as described above, ensures that flashlight 10 remains substantially waterproof at all times.

It will be readily understood, by those skilled in the art, in respect of a rechargeable version of a lighting device, that it is advisable to provide venting of the battery housing during recharging.

It will be understood that the invention disclosed and defined herein extends to all alternative combinations of two or more of the individual features mentioned or evident from the text. All of these different combinations constitute various alternative aspects of the invention.

The foregoing describes embodiments of the present invention and modifications, obvious to those skilled in the art can be made thereto, without departing from the scope of the present invention.

The invention claimed is:

1. A flashlight, comprising:

a housing, including an aperture, a first end, and a second end;

a light source within the housing, wherein the light source is located nearer to the first end of the housing relative to the second end of the housing;

a power source within the housing;

a first tapered slot located on a first side of the housing and a second tapered slot located on an opposite side of the housing, wherein the first and second tapered slots extend alone a length of the housing between the first and second ends and taper inward in a direction from the first end to the second end, and the first and second tapered slots are received by a base charging unit when the flashlight is inserted into the base charging unit to charge the power source;

an electrical switch accessible through the aperture, wherein the electrical switch is configured to toggle an electrical circuit that is in electrical communication with the light source and the power source between an open circuit and a closed circuit;

a resilient cover extending over the electrical switch and providing a waterproof seal for the housing preventing ingress of water through said aperture; and at least one indicator being visible through said cover at least when said indicator is illuminated, wherein said indicator is configured to illuminate when said switch is in said circuit open condition and said flashlight receives power only from said power source.

2. The flashlight as claimed in claim 1, wherein said at least one indicator continuously flashes using power from the power source so long as the power source provides suitable power to illuminate the indicator means.

3. The flashlight as claimed in claim 1, wherein said at least one indicator includes a light source for indicating a status of the power source.

4. The flashlight as claimed in claim 3, wherein said at least one indicator includes a light source for indicating a recharging status of the power source.

5. The flashlight as claimed in claim 3, wherein said at least one indicator includes a light source for indicating a discharging status of the power source.

6. The flashlight as claimed in claim 1, wherein said aperture is provided in a recess in said housing.

7. The flashlight as claimed in claim 6, wherein said cover cooperates with a rim of said recess to provide a waterproof seal.

8. The flashlight as claimed in claim 1, wherein said switch is actuated by a switch actuator which passes through said aperture, to enable a user to push said actuator to actuate said switch.

9. The flashlight as claimed in claim 1, wherein said at least one indicator includes at least one LED.

10. The flashlight as claimed in claim 1, wherein said at least one indicator passes through said housing.

11. The flashlight as claimed in claim 1, including at least a pair of indicator, wherein each of the indicator indicates a different state of the flashlight.

12. The flashlight as claimed in claim 1, including three indicators, wherein a first indicator illuminates when the power source is recharging, a second indicator illuminates when the power source is fully charged, and a third indicator continuously intermittently blinks when power is available from the power source.

13. The flashlight as claim in claim 1, wherein the at least one indicator is disposed under the resilient cover.

14. The flashlight as claimed in claim 1, wherein at least part of the resilient cover is translucent.

15. The flashlight as claimed in claim 1, wherein at least part of the resilient cover is transparent.

16. The flashlight as claimed in claim 1, wherein the cover is of an elastomeric or polymeric material.

17. The flashlight as claimed in claim 1, wherein the cover includes silicon.

18. The flashlight as claimed in claim 1, wherein the power source includes a rechargeable battery.

19. The flashlight as claimed in claim 18, wherein said flashlight includes connector for connecting said rechargeable battery to an external power supply to recharge the battery.

20. The flashlight as claimed in claim 19, wherein said flashlight includes a recharging circuit, to which said indicator is electrically connected.

21. The flashlight as claimed in claim 1, wherein said indicator is visible through said cover, when said indicator is or is not indicating a status of said power source.

22. The flashlight as claimed in claim 1, wherein said flashlight is a waterproof flashlight.

23. The flashlight of claim 1, wherein each of the first and second tapered slots includes:

a broad open end;

a narrow closed end;

a floor coupled to and extending between the broad and narrows ends;

an upper surface; and a lower surface, wherein the upper and lower surfaces are coupled to and extend between the broad and narrows ends along the floor, and the upper and lower surfaces curve towards each other from the broad end to the narrow end.

24. A waterproof flashlight including:

a flashlight housing defining an electrical contact aperture opening therethrough;

a flashlight electrical contact for electrical connection of the flashlight to a power source external to the flashlight, the flashlight electrical contact extending from inside the housing through the aperture and being disposed partly outside the flashlight housing and including a flange located outside of the housing that provides a shoulder adjacent the housing;

resilient sealing means sandwiched between the shoulder and the flashlight housing to establish a water tight seal between the shoulder and the housing; and contact connection means for connecting the flashlight electrical contact to the flashlight housing, the contact connection means extending from the flashlight electrical contact through the contact aperture and including securement means securing the contact connection means in relation to the flashlight housing such that the shoulder maintains the sealing means under compression.

25. The flashlight as claimed in claim 24, wherein the resilient sealing means is an elastomeric washer.

26. The flashlight as claimed in claim 24, wherein the contact connection means includes a shaft portion extending from the flashlight electrical contact.

27. The flashlight as claimed in claim 24, wherein the securement means is disposed within the flashlight housing and is constituted by a deformable portion of the contact connection means, configured to be rolled downwards to press against the inside of the housing, urging the shoulder towards the housing, which generates the compression so as to lock the contact connection means and hence the flashlight electrical contact, in place relative to the flashlight.

28. The flashlight as claimed in claim 24 including a washer disposed between the deformable portion and an inner wall of the flashlight housing.

29. The flashlight as claimed in claim 24, wherein the flashlight electrical contact and the contact connection means are a unitary component.

30. The flashlight as claimed in claim 29, wherein the unitary component is in the form of a rivet.

31. The flashlight as claimed in claim 24, wherein the shoulder is defined by a flange.

32. The flashlight as claimed in claim 24, wherein the flashlight housing defines a recess having a recess floor, the flashlight electrical contact being disposed within the recess and projecting from the contact aperture and outwardly from the recess floor.

* * * * *